United States Patent [19]

Gorsh

[11] 4,347,938

[45] Sep. 7, 1982

[54] RUNNING SKYLINE INTERMEDIATE SUPPORT AND MULTI-SPAN CARRIAGE

[75] Inventor: Joseph W. Gorsh, Missoula, Mont.

[73] Assignee: The United States of America as represented by the Secretary of Agriculture, Washington, D.C.

[21] Appl. No.: 102,484

[22] Filed: Dec. 11, 1979

[51] Int. Cl.[3] ..... B66C 21/00

[52] U.S. Cl. ..... 212/121; 212/71; 212/76; 212/83; 212/117; 104/115; 104/197; 24/221 A

[58] Field of Search ..... 104/115–116, 104/124–125, 178, 181–182, 197; 248/65; 212/71–72, 74–75, 76, 78, 83, 87, 90–91, 94, 97, 113, 117, 121; 24/73 RM, 205.18, 221 A

[56] References Cited

U.S. PATENT DOCUMENTS

| | | | |
|---|---|---|---|
| Re. 27,621 | 4/1973 | McIntyre et al. | 212/90 |
| 1,003,950 | 9/1911 | Rosada | 104/115 |
| 1,144,060 | 6/1915 | Phillips | 104/115 |
| 1,206,581 | 11/1916 | Opsal | 104/115 |
| 1,222,007 | 4/1917 | McGuire | 104/115 |
| 1,484,387 | 2/1924 | Dickinson | 212/121 |
| 1,569,176 | 1/1926 | Dunham | 212/90 |
| 1,801,527 | 4/1931 | Newell | 104/115 |
| 2,753,610 | 7/1956 | Miller | 24/221 A |
| 3,382,816 | 5/1968 | Goforth et al. | 104/197 |
| 3,563,367 | 2/1971 | Breuer | 24/73 RM |

FOREIGN PATENT DOCUMENTS

| | | | |
|---|---|---|---|
| 649467 | 10/1962 | Canada | 104/182 |
| 157054 | 11/1903 | Fed. Rep. of Germany | 104/197 |
| 1430976 | 3/1969 | Fed. Rep. of Germany | 104/197 |
| 1029513 | 6/1953 | France | 104/115 |
| 357237 | 9/1931 | United Kingdom | 212/71 |
| 237186 | 2/1969 | U.S.S.R. | 104/182 |

*Primary Examiner*—Sherman D. Basinger
*Assistant Examiner*—R. B. Johnson
*Attorney, Agent, or Firm*—M. Howard Silverstein; David G. McConnell

[57] ABSTRACT

A yarder is employed with a running skyline provided with a carriage. The running skyline has an intermediate suspended support consisting of a hanger bar with a shoe pivotally connected to the lower end of the hanger bar by a transverse shaft. The shoe has supporting sheaves and an enclosure rail, with the skyline haulback line supportingly received between the rail and the sheaves. The carriage is open on one side so as to be able to pass the transverse shaft of the intermediate suspended support. The open side of the carriage has a yieldable safety gate which allows the carriage to pass the transverse shaft but which retains the haulback line within the carriage. The lower portion of the carriage has respective sheaves for a slack pulling line and a log suspension line to which logs to be transported are connected. A mainline extends between the yarder and a junction member connected to both the slack pulling line and the log suspension line. The upper portion of the carriage has sheaves normally engageable on the haulback line and substantially conformably engageable on the rail when the carriage passes the intermediate suspended support.

8 Claims, 11 Drawing Figures

RUNNING SKYLINE INTERMEDIATE SUPPORT AND MULTI-SPAN CARRIAGE

FIELD OF THE INVENTION

This invention relates to logging systems, and more particularly to a logging system employing a yarder and a skyline attached thereto, the skyline having a suspended intermediate support to enable logs attached to a carriage to be moved on the skyline without coming in contact with the ground.

BACKGROUND OF THE INVENTION

Skyline logging systems are cable logging systems used to harvest timber from hillsides too steep for tractor logging. Skyline logging systems utilize a carriage, similar to a trolley, to yard (move) logs from the location where they are felled to the landing (a location where the logs are concentrated for loading onto trucks). During the in-haul phase of the operation, the logs are carried in with their leading edges suspended free of the ground. An intermediate support for the skyline may be employed where there is a rise or hump between the yarder and the location from which the logs are transported, to provide the necessary ground clearance.

Logging over an intermediate support has been performed since the early part of the present century. Since its inception it has been used with standing skyline systems. These are systems which operate with the skyline anchored at one end while the other end is held in position with a brake for the entire setting. Once the skyline is laid in the intermediate support and raised into position, it does not move longitudinally in the support. Thus, in the previously employed systems the intermediate support engages a stationary line.

In modern systems, the haulback line is utilized to support both the carriage and the turn of logs. Therefore if an intermediate support is to be employed, it must support the haulback line, which always moves in a direction opposite to that of the carriage. Thus, there is a substantial need for an intermediate support which will sustain a moving line, such as a haulback line moving in a direction opposite to that of the carriage employed in the system, which will allow the carriage to pass it while still providing the required support, and which will retain the associated fast-moving and undulating cable.

A preliminary search of the prior patented art revealed the following prior U.S. Pat. Nos. of interest: Pendelton, 1,527,489, McIntyre, 2,600,066, McIntyre, 3,083,839, Matheson, 3,221,897, Pelton et al, 3,346,127, Stewart, 3,359,919, Christensen, 3,948,398, Morrow et al, 4,136,786.

SUMMARY OF THE INVENTION

The present invention comprises a system wherein the intermediate support differs from the previously employed intermediate supports inasmuch as it supports a haulback line moving in the opposite direction of the carriage itself, whereas prior intermediate supports sustain a stationary line. The running skyline intermediate support of the present invention includes three important structural features: (1) a J-hook member which is hung from one or more intermediate conveniently located trees and is used to support a shoe assembly, (2) the shoe assembly contains two sheaves, one on either end of a shoe to support the moving haulback line, and (3) a rail in the shoe encompassing the haulback line and keeping it from jumping out of the sheaves. Both elements of the shoe assembly pivot around a transverse support shaft which is fixed to the J-hook member. The associated carriage has an open side which allows the carriage to pass by the intermediate support and to move from span to span. The open side has a spring-biased safety gate which yields to the intermediate support as the carriage passes. As soon as the support clears the gate, the tension spring returns it to an upright position, which thus prevents the carriage from falling to the ground should it slip from its haulback line. The carriage upper portion has a pivoted walking beam provided with two sheaves spaced apart, serving three purposes: (1) the two sheaves function as a single sheave with a diameter much larger than that which could be contained in the upper carriage portion, (2) the separation of the two sheaves provides better tracking characteristics for the leading end of the loaded carriage, and (3) the pivoting action of the walking beam itself dampens the vibration transmitted to the carriage by the undulating haulback line and also greatly reduces the shock to the carriage as it comes into contact with the intermediate support. The pivoting action of both the above-mentioned shoe of the intermediate support and the walking beam of the carriage combine their compromising actions as the carriage approaches the support, easing the carriage up and over the support.

Accordingly, a main object of the invention is to provide an improved skyline yarding system which overcomes the deficiencies and disadvantages of the cable logging systems heretofore employed.

A further object of the invention is to provide an improved skyline logging system which employes an intermediate support and a moving haulback line engaged on the support, with a log-supporting carriage supported on the haulback line and moving in a direction opposite to that of the haulback line, and arranged so that it can pass the intermediate support without becoming disengaged from the haulback line.

A still further object of the invention is to provide an improved skyline yarding system having an intermediate support and a moving haulback line engaged on the support, with a carriage connected to the haulback line and engaged therein so that it moves in a direction opposite to that of the haulback line, the carriage being constructed so that it can pass the intermediate support and having a spring-biased gate preventing disengagement of the carriage from the haulback line during such passage, the intermediate support and the carriage having cooperating pivoted parts which facilitate the smooth passage of the carriage relative to the support.

A still further object of the invention is to provide an improved skyline yarding system employing an intermediate skyline support assembly of the J-hook type which involves relatively simple parts, which is easy to install, and which provides reliable and safe support of the associated skyline cables.

A still further object of the invention is to provide an improved skyline yarding system having an intermediate support and a load-bearing carriage movable on the haulback line of the system and having an open side so that the carriage can be moved past the intermediate support, the open side being provided with a normally closed safety gate which is yieldable as it comes into contact with the intermediate support but which immediately repositions itself as it passes the support to prevent separation of the carriage from the haulback line.

A still further object of the invention is to provide an improved skyline yarding system of the running skyline type with multi-span capability, the system including at least one intermediate support and having a load-carrying carriage with an open side enabling the carriage to move past the intermediate support, the carriage having a pivoted walking beam with spaced sheaves providing improved carriage tracking characteristics, and having a spring-loaded safety gate preventing the carriage from disengaging from its haulback line as the carriage moves past the intermediate support, the intermediate support having a pivoted shoe coacting with the walking beam to facilitate smooth movement of the carriage past the intermediate support.

BRIEF DESCRIPTION OF THE DRAWINGS

Further objects and advantages of the invention will become apparent from the following description and claims, and from the accompanying drawings, wherein:

DESCRIPTION OF A PREFERRED EMBODIMENT

Figure 1:
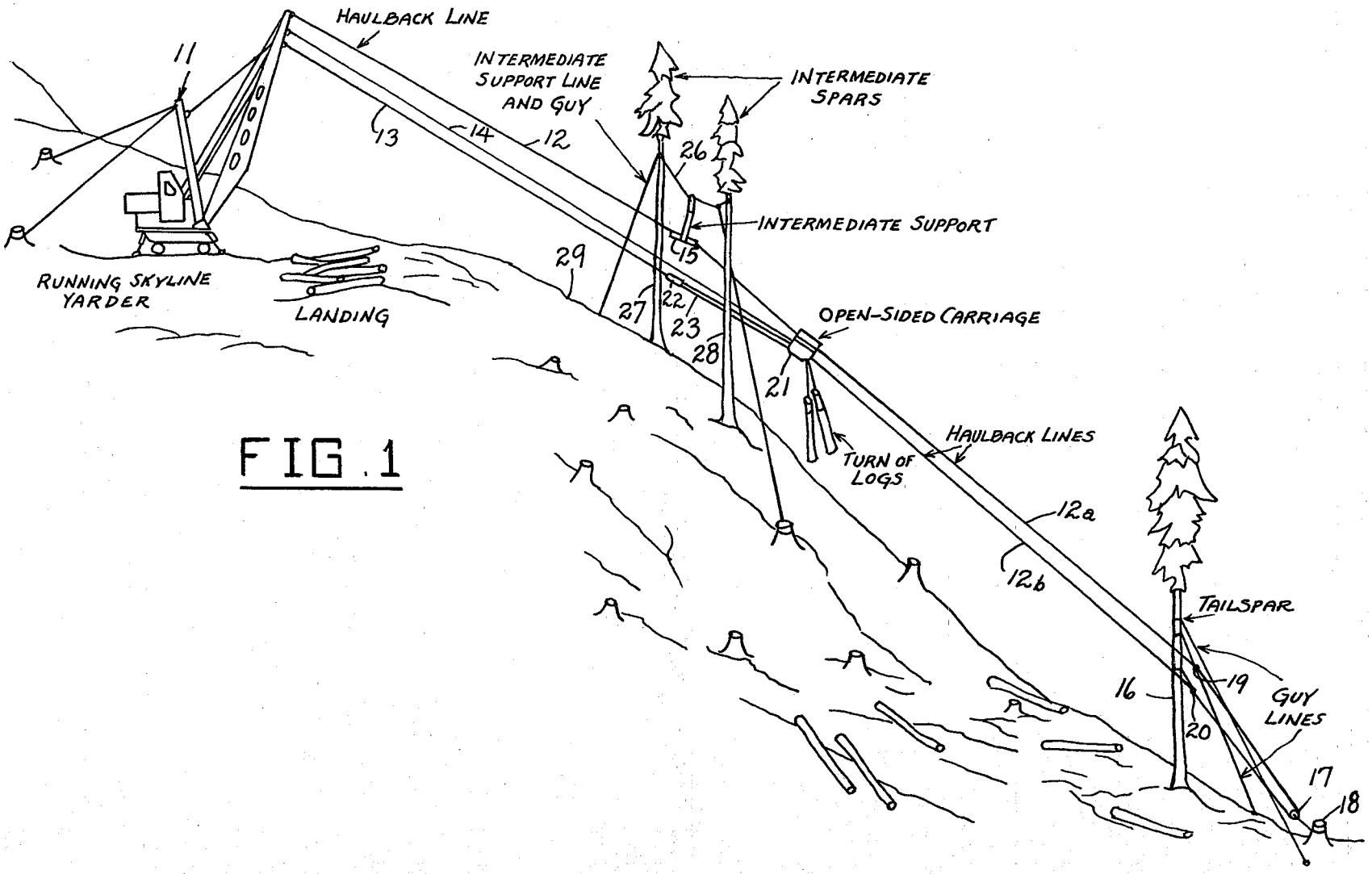
FIG. 1 is a schematic illustration of a multi-span logging system embodying the present invention.
Figure 2:
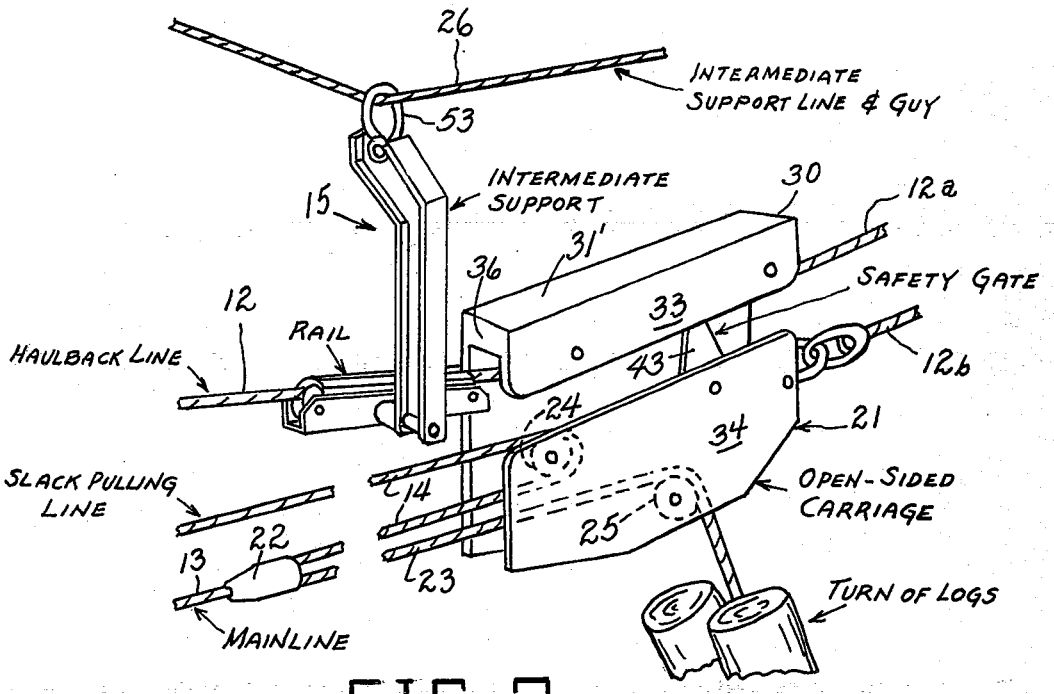
FIG. 2 is a perspective view showing the intermediate support assembly and carriage employed in the logging system of FIG. 1.

Referring to the drawings, FIG. 1 diagrammatically illustrates a typical multi-span, running skyline logging system embodying the improved features of the present invention. The logging system employs a conventional yarder 11 with rigging including a haulback line 12, a mainline 13 and a slack pulling line 14. The haulback line 12 extends over an intermediate support assembly 15 located at a suitable position between the yarder 11 and a tailspar tree 16 near the log-felling location. In the illustrated typical system, the haulback line extends around a sheave 17 anchored to a stump 18, the upper and lower haulback line elements **12*a* and 12*b* being supported on respective sheaves 19 and 20 connected to the tailspar tree 16. The lower haulback line element 12*b* is connected to a carriage 21 movably supported on the upper haulback line element 12*a*, as will be presently described. The mainline 13 is connected to a junction member 22, to which are respectively connected the slack pulling line 14 and the load supporting line 23. As shown in FIG. 2, the slack pulling line 14 and load supporting line 23 extend around respective spaced sheaves 24 and 25 journalled in the lower portion of carriage 21**.

The intermediate support assembly 15 may be suspended from a support line and guy cable 26 connected to and supported on a pair of intermediate spar trees 27 and 28 suitably located on opposite sides of the haulback and other rigging lines at the region requiring the extra height of the lines, for example, at a hump or rise 29 between the yarder 11 and the tailspar tree 16.

Figure 3:
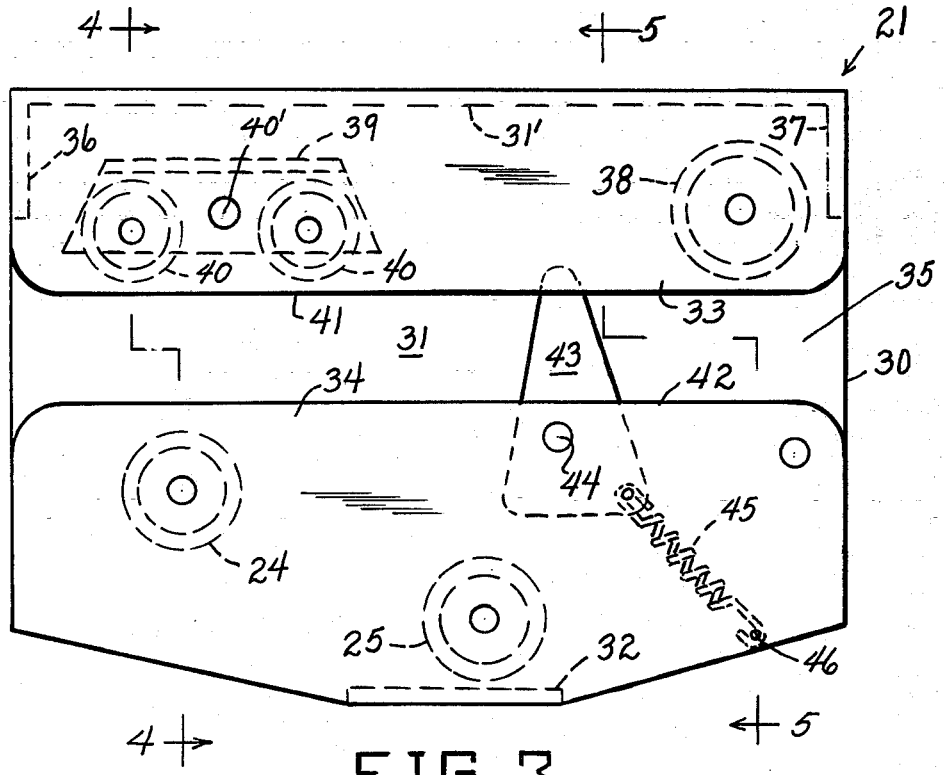
FIG. 3 is an enlarged front elevational view of the carriage shown in FIG. 2.
Figure 4:
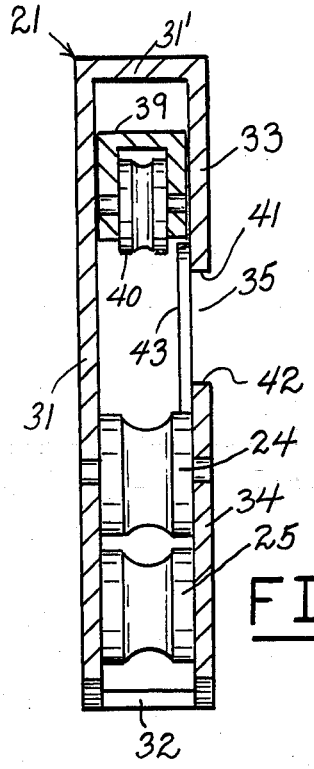
FIG. 4 is a transverse vertical cross-sectional view taken substantially on line 4—4 of FIG. 3.
Figure 5:
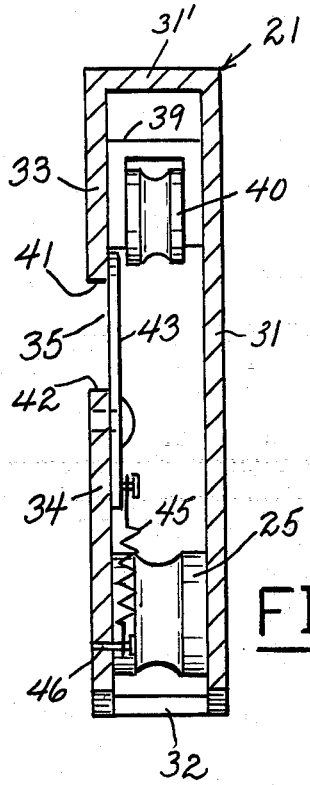
FIG. 5 is a transverse vertical cross-sectional view taken substantially on line 5—5 of FIG. 3.

Referring to FIGS. 3 to 5, the carriage 21 comprises a generally rectangular sleeve-like main body 30 having a rear wall 31, a full-length top wall 31', a reduced-length bottom wall 32 subjacent the load-bearing sheave 25, of sufficiently short length to provide clearance for the depending portion of load-supporting line 23, and upper and lower front wall flanges 33, 34 defining a longitudinal open slot 35 therebetween. Transverse short depending end wall elements 36 and 37 may be provided at the top corners of the carriage body 30.

A top sheave 38 is journalled in the upper right corner portion of the carriage body 30, as viewed in FIG. 3. A channel-shaped walking beam member 39 is centrally pivoted at 40' in the upper left portion of body 30. Spaced sheaves 40, 40 are journalled in the opposite end portions of the channel-shaped member 39. The bottom edge 41 of flange 33 is located below the normal level of the bottom of the peripheries of the sheaves 40, 40 and 38. The top edge 42 of flange 34 is located above the level of the top of the periphery of sheave 24.

A generally triangular flat gate member 43 is pivotally connected at 44 to the upper margin of flange 34. A biasing coiled spring 45 connects the lower right corner of gate member 43, as viewed in FIG. 3, to a rightwardly-spaced pin 46 mounted on the lower portion of flange 34, biasing gate member 43 to an upright position overlapping the slot 35.

Figure 8:
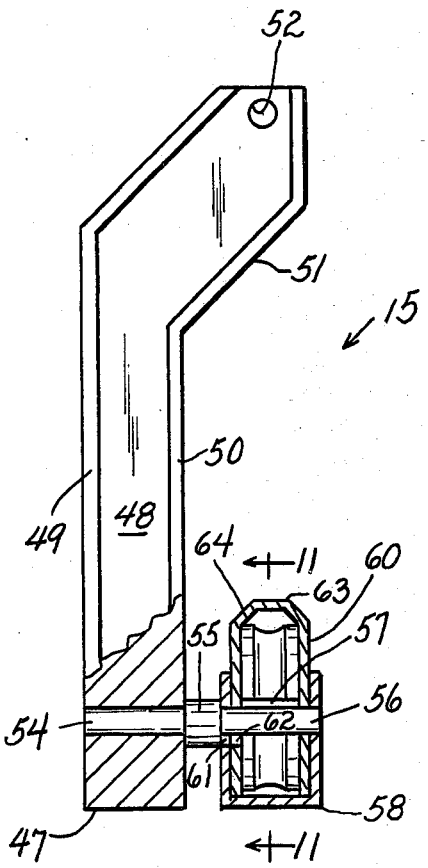
FIG. 8 is an enlarged transverse vertical cross-sectional view taken substantially on line 8—8 of FIG. 6.
Figure 11:
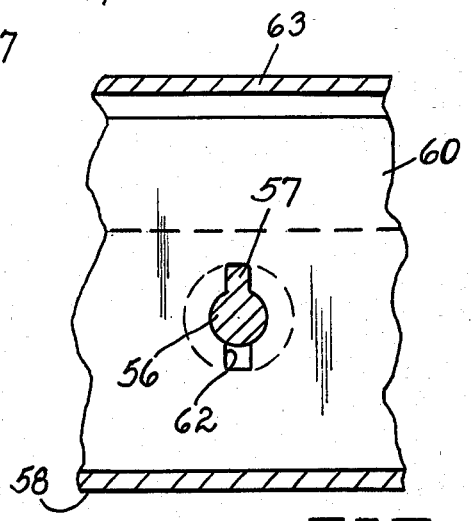
FIG. 11 is an enlarged fragmentary vertical cross-sectional view taken substantially on line 11—11 of FIG. 8.
Figure 9:
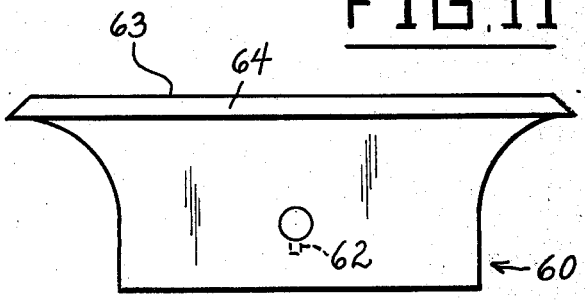
FIG. 9 is an enlarged front elevational view of the cable-retaining rail member employed in the intermediate support assembly of FIG. 6.
Figure 10:
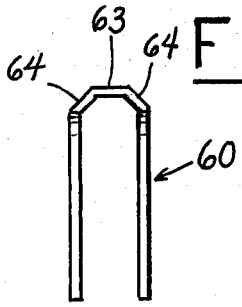
FIG. 10 is an enlarged end elevational view of the cable-retaining rail member of FIG. 6.

Referring to FIGS. 6 to 10, the intermediate support assembly 15 comprises a "J-hook" or hanger bar member 47, which may be of generally I-shaped cross-section including a web 48 and opposite flanges 49 and 50. The upper end portion of member 47 is offset rightwardly, as viewed at 51 in FIG. 8, and the top end of the web is provided with an attachment hole 52 for connection to a suspension eye member, or shackle, 53, shown in FIG. 2, for suspending the assembly 15 on the support line 26. A rightwardly extending shaft member 54 is rigidly secured in the lower end of member 47, as seen in FIG. 8, said shaft member having an enlarged integral collar or spacer means portion 55 and a shaft extension 56 formed with an intermediate upstanding integral longitudinal key 57.

Figure 6:
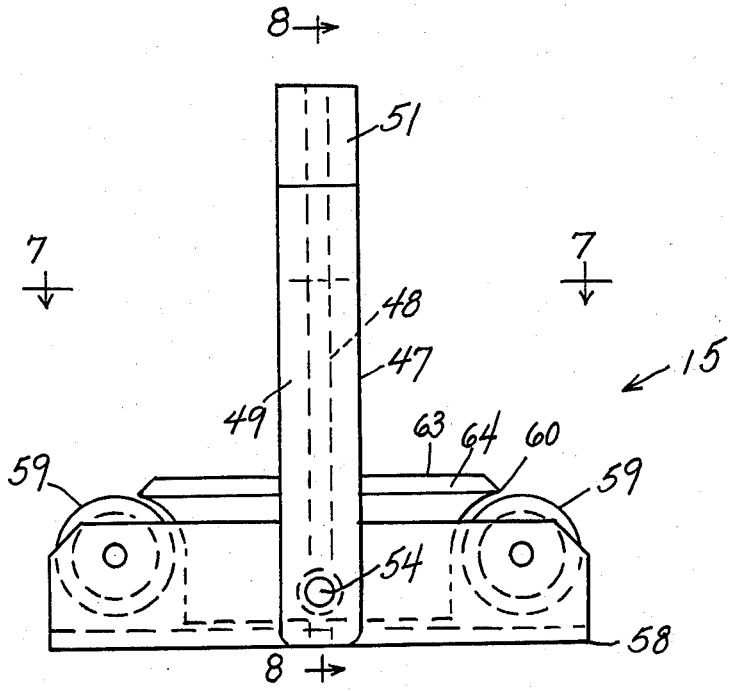
FIG. 6 is an enlarged front elevational view of the intermediate support assembly shown in FIG. 2.
Figure 7:
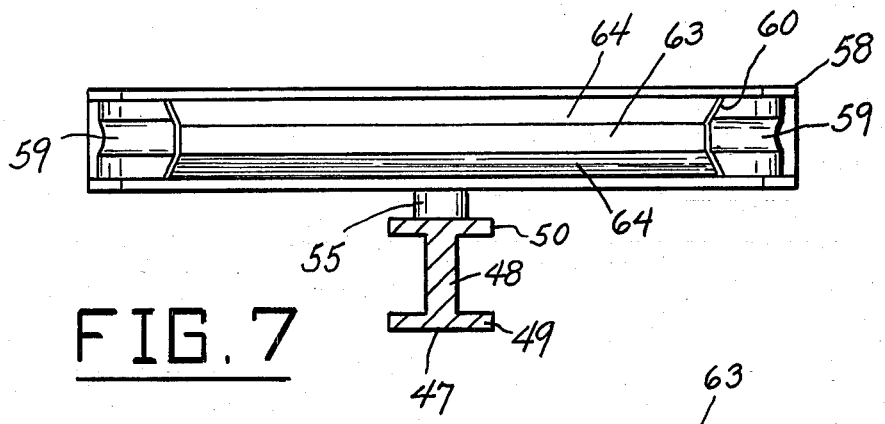
FIG. 7 is an enlarged horizontal cross-sectional view taken substantially on line 7—7 of FIG. 6.

Designated at 58 is a channel-shaped upwardly facing shoe member in the opposite ends of which are journalled respective sheaves 59, 59. A downwardly-facing, channel-shaped rail or cover means member 60 is disposed in the shoe member 58, with its flanges closely received in said shoe member, said rail member being arcuately concavely shaped at its ends so as to be conformably received between the sheaves 59, 59, as shown in FIG. 6. The left flange of shoe member 58 and of rail member 60, as viewed in FIG. 8, are formed with registering keyhole-shaped apertures 61, 62 permitting passage of shaft extension 56 and key 57 therethrough when the member 47 is inverted (rotated 180°) from the position thereof shown in FIG. 8. The right flanges of shoe member 58 and of rail member 60 have registering circular apertures, aligned with said keyhole-shaped apertures, receiving the right end portion of shaft extension 56. With member 47 in said inverted position, the shaft extension 56 may thus be interengaged with the nested flanges of the members 58 and 60 via the registering apertures of the flanges, and the member 47 may then be rotated 180° to the position shown in FIG. 8, wherein key 57 rotatably locks the shaft extension 56 relative to the interengaged members 58, 60, while allowing free pivoting of the interengaged shoe members relative to the suspension member 47. It will also be seen from FIG. 8 that the nested members 58, 60 are locked against movement relative to each other while being allowed to pivot as a unit with respect to member 47.

The top wall of rail member 60, shown at 63, is bevelled at its longitudinal edges, as shown at 64, 64, to provide a rail contour substantially conforming with the peripherally grooved configuration of the carriage sheaves 40, 40 and 38 so as to facilitate movement of the carriage assembly over the intermediate support shoe assembly. During such movement, the collar element 55 travels in the slot 35 and engages the yieldable gate member 43, which yields to allow passage of the carriage but immediately returns to upstanding locking position, shown in FIG. 3, whereby to prevent the carriage from falling to the ground should it slip from the haulback line 12.

The rail 60, in the shoe 58, encompasses the haulback line 12, and keeps it from jumping out of the sheaves 59, 59. Both of the channel elements 58, 60 pivot as a unit around the transverse shaft element 56, fixed to the J-hook member 47.

The intermediate support assembly 15 is utilized by carrying it to the location between the two selected intermediate spar trees 27, 28, namely, near the point where the running lines would come into contact with the ground for lack of clearance. The haulback line 12 is then slackened to lie on the ground. With the sheaves 59, 59 facing upward, the shoe member 58 is placed under the line 12 and the line is placed in the sheaves 59, 59. The rail member 60 is placed in the shoe member 58 over the haulback line 12, holding it in the sheaves. The J-hook member 47 is turned upside down and the shaft extension 56 is engaged through the shoe assembly via the keyhole apertures 61, 62 to fully inserted position, with its outer end received in the registering circular holes in the outer flanges of members 60, 58, and with the collar element 55 substantially abutting the inner flange of shoe member 58. With the shaft extension 56 thus fully engaged, the J-hook member 47 is then rotated 180° to its upright position shown in FIGS. 6 and 8. This locks the shoe 58 and rail 60 together without requiring the use of fasteners such as special nuts, pins, or the like, yet it allows the shoe assembly to rotate freely about the shaft extension 56. The intermediate support assembly 15, with the enclosed haulback line 12 is then raised into operating position and secured to the support line 26, providing the necessary clearance above ground for the carriage and its load to pass.

In operation, the open side slot 35 allows the carriage 21 to pass by the intermediate support 15 from span to span. The safety gate 43 yields to the intermediate support 15 as the carriage 21 passes. As soon as the support 15 clears the gate 43, the tension spring 45 returns the gate to its upright position. The purpose of the safety gate is to prevent the carriage from dropping to the ground should it slip from the haulback line 12.

The walking beam 39 serves three purposes: (1) having two sheaves 40, 40 spaced apart, they function as a single sheave with a diameter much larger than what could be contained in the upper portion of the carriage; (2) the separation of the two sheaves 40,40 provides better tracking characteristics for the leading end of the loaded carriage; (3) the pivoting action of the walking beam itself dampens the vibrations transmitted to the carriage by the undulating haulback line. The pivoting beam action also reduces the shock to the carriage as it comes in contact with the rail 60 of the intermediate support by one-half.

The pivoting actions of both the shoe assembly 58,60 of the intermediate support 15 and the walking beam 39 of the carriage 21 combine their mutually compliant actions as the carriage approaches the support, easing the carriage up and over the support.

An alternative method of fabricating the shoe of the intermediate support and the three upper sheaves in the carriage which ride the haulback line would be to laminate or coat them with a high-impact, abrasion-resistant plastic or rubber between the sidewalls of the shoe and the sidewalls of the sheaves. This would reduce the impact of the metal to metal as the carriage passes the intermediate support.

In the operation of the above-described running skyline system, the haulback line 12 is utilized to support the carriage 21 and the turn of logs carried thereby. Therefore the intermediate support 15 must support the haulback line 12 as well as the carriage, with the haulback line always moving in the opposite direction to the carriage. A particular problem is that of keeping the fastmoving and undulating cable 12 in the high-speed sheaves 59, 59 of the shoe assembly, and this problem is overcome by the encasement of the cable in the rail member 60.

While a specific embodiment of an improved running skyline logging system has been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiment.

What is claimed is:

1. A logging system comprising a yarder, tail-spar means, running skyline means interconnecting the yarder and said tailspar means, load carriage means, means movably supporting said carriage means on said skyline means, said skyline means including a haulback line, intermediate support means located between the yarder and said tailspar means, said intermediate support means comprising intermediate spar means, a hanger bar suspended from said intermediate spar means, shoe means adjacent to the lower portion of said hanger bar and supportingly engaging said haulback line on the underside thereof, and transverse shaft means pivotally connecting said shoe means to said hanger bar, said carriage means having a longitudinally extending side opening located to form a passageway for said transverse shaft means when the carriage means moves past said shoe means, said shoe means comprising longitudinal cover means retentively surrounding the haulback line, said longitudinal cover means comprising a downwardly facing channel-shaped elongated rail member mounted on said shoe means, said carriage means comprising sheave means engageable on said rail member, said sheave means including a walking beam member pivoted to said carriage means, a pair of sheaves mounted on opposite sides of the pivotal connection of said walking beam member to said carriage means, said sheaves being engageable on said rail-member, and movable safety gate means on said carriage means normally overlapping said side opening and being yieldably engageable by said transverse shaft means to allow the carriage to move past said shoe means.

2. The logging system of claim 1, wherein said transverse shaft means includes spacer means to space the shoe means from the hanger bar, said open side portion being substantially in the same vertical plane as said spacer means and wherein said spacer means comprises enlarged abutment collar means on said transverse shaft means.

3. The logging system of claim 1, and wherein said safety gate means comprises a flat member pivoted to said carriage means adjacent to said side opening, and spring means biasing said flat member to an upright position overlapping said side opening.

4. The logging system of claim 3, and wherein said transverse shaft means includes spacer collar means to space the shoe means from the hanger bar, said side opening and flat member being substantially in the vertical plane of said spacer collar means, whereby said spacer collar means is engageable with the flat member to rotatably displace said flat member and thereby allow the carriage means to move past said shoe means.

5. The logging system of claim 1, wherein said hanger bar is laterally offset at its top portion, wherein said shoe means is located substantially in vertical alignment with the laterally offset top portion of the hanger bar, and wherein said carriage means is of generally longitudinally sleeve-like shape arranged to receive said shoe means in its upper portion.

6. The logging system of claim 5, wherein said transverse shaft means includes enlarged spacer collar means between the shoe means and the hanger bar, and said open side opening being located to receive said spacer collar means as the carriage means passes the shoe means.

7. The logging system of claim 6, and wherein said shoe means is provided with a downwardly-facing channel-shaped rail member retentively covering said haulback line and defining a track for the carriage means.

8. The logging system of claim 1, wherein said shoe means comprises elongated tubular housing means to movably receive a cable portion of the running skyline means and formed to define a rail for at times providing tracking support of the carriage means and wherein said transverse shaft means includes enlarged spacer collar means between the shoe means and the hanger bar, said transverse shaft means being fixed to the hanger bar and having an outer extension shaft portion provided with a retention key lockingly receivable in said tubular housing means, the wall portion of said tubular housing means adjacent said spacer collar means having a keyhole-shaped aperture oriented to permit insertion of said outer extension shaft portion only when the hanger bar is in a substantially inverted position relative to its normal position with respect to the shoe means.

* * * * *